US010478664B2

(12) United States Patent
Kiani

(10) Patent No.: US 10,478,664 B2
(45) Date of Patent: Nov. 19, 2019

(54) EXERCISE APPARATUS WITH DIVERGENT/CONVERGENT MOTION ALONG THE SYMMETRIC SEMI ELLIPTICAL ROUT

(71) Applicant: Ali Kiani, Coquitlam (CA)

(72) Inventor: Ali Kiani, Coquitlam (CA)

( * ) Notice: Subject to any disclaimer, the term of this patent is extended or adjusted under 35 U.S.C. 154(b) by 0 days.

(21) Appl. No.: 15/947,754

(22) Filed: Apr. 6, 2018

(65) Prior Publication Data

US 2018/0290012 A1 Oct. 11, 2018

(30) Foreign Application Priority Data

Apr. 11, 2017 (CA) ..... 2963803

(51) Int. Cl.

| | |
|---|---|
| ***A63B 22/00*** | (2006.01) |
| ***A63B 21/005*** | (2006.01) |
| *A63B 22/06* | (2006.01) |
| *A63B 21/22* | (2006.01) |
| *A63B 22/20* | (2006.01) |
| *A63B 24/00* | (2006.01) |

(52) U.S. Cl.

CPC ..... *A63B 22/001* (2013.01); *A63B 21/0051* (2013.01); *A63B 22/0005* (2015.10); *A63B 22/0025* (2015.10); *A63B 22/0061* (2013.01); *A63B 21/225* (2013.01); *A63B 22/0664* (2013.01); *A63B 22/203* (2013.01); *A63B 24/0087* (2013.01); *A63B 2022/0033* (2013.01); *A63B 2022/0035* (2013.01); *A63B 2022/0676* (2013.01); *A63B 2225/09* (2013.01); *A63B 2230/06* (2013.01); *A63B 2230/75* (2013.01)

(58) Field of Classification Search

CPC ..... A63B 22/0005; A63B 22/001; A63B 22/0025; A63B 22/0664; A63B 2022/0033; A63B 2022/0035; A63B 2022/0676; A63B 21/0051; A63B 21/225; A63B 22/0061; A63B 22/203; A63B 24/0087; A63B 2225/09; A63B 2230/06; A63B 2230/75

See application file for complete search history.

(56) References Cited

U.S. PATENT DOCUMENTS

| | | | | |
|---|---|---|---|---|
| 6,846,272 | B2 * | 1/2005 | Rosenow | A63B 22/0017 482/52 |
| 7,780,577 | B2 * | 8/2010 | Arnold | A63B 22/001 482/51 |
| 9,199,115 | B2 | 12/2015 | Yim et al. | |
| 9,586,086 | B2 | 3/2017 | Dalebout et al. | |
| 10,046,196 | B2 | 8/2018 | Ercanbrack et al. | |
| 2016/0001122 | A1 | 1/2016 | Dalebout et al. | |
| 2016/0346599 | A1 | 12/2016 | Dalebout et al. | |
| 2017/0056717 | A1 | 3/2017 | Ercancrack et al. | |

* cited by examiner

*Primary Examiner* — Megan Anderson

(57) ABSTRACT

An exercise apparatus enabling a user to move the hands forward/backward in the same direction longitudinally and in opposite direction of the feet while the user's hands and feet move in a divergent/convergent manner laterally along a symmetrical semi elliptical routes.

9 Claims, 14 Drawing Sheets

EXERCISE APPARATUS WITH DIVERGENT/CONVERGENT MOTION ALONG THE SYMMETRIC SEMI ELLIPTICAL ROUT

1. FIELD OF THE INVENTION

The invention relates to the field of exercise equipment and in particular motion base mechanisms to be used to enable user to move hands forward/backward in the same direction so that hands have a lateral divergent motion at the start of the route and lateral convergent motion at the end of the route. By moving hands along the symmetric semi elliptical route a symmetrical variable pressure will be applied on the different muscles. Feet move along the symmetric semi elliptical route in full harmony with hands so that hands move backward/forward in the opposite direction of feet.

2. BACKGROUND

Maintaining proper fitness is growing concern from many people. Medical community has become increasingly aware in the value of exercise to the overall health of an individual. Furthermore, athletes need regular and stringent workout to maintain their abilities. Exercise apparatuses have been, and still are, an important part of the sport and workout. Exercise apparatuses have evolved from simple equipment to advanced and technically sophisticated equipment with special mechanisms. Using mechanical and electrical parts and new software enable user to take more advantage of exercise apparatuses.

In conventional exercise machine usually the user moves hands or feet in the opposite direction, this means at the certain moment while hands are being moved in the opposite direction and usually along the simple route, an asymmetrical pressure will be applied on the muscles of user's upper body also asymmetrical pressure will be applied on the feet and lower body's muscles. By moving hands forward/backward in the same direction and along the symmetric semi elliptical route, user will experience a new type of symmetrical load on his muscles and at the same time feet are being moved along the symmetric semi elliptical route in full harmony with hands so that hands move backward/forward in the opposite direction of feet Also semi elliptical route varies direction and magnitude of the forces on the different muscles and this helps user to experience a new type of exercise.

3. DESCRIPTION

Described exercise apparatus enabling a user to move hands forward/backward in the same direction so that the user's hands have a lateral divergent motion at a start of a route and lateral convergent motion at a end of the route The user's feet move along a symmetric semi elliptical routes in full harmony with the user's hands so that the user's hands move backward/forward in a opposite direction of the user's feet.

SUMMARY OF THE INVENTION

According to this invention an exercise apparatus with divergent/convergent motion comprises a base frame, a an upper synchronized mechanism mounted on an upper end of the base frame, a lower synchronized mechanism mounted on a lower end of the said base frame, a power transmission systems, a flywheel, a slide unit, a controlling means for adjusting resistance force.

a base frame adapted to be supported on a supporting surface having an upper end and a lower rear end, a an upper synchronized mechanism mounted at the upper end of said base frame including two link mechanisms, each link mechanism symmetrically positioned at a left and a right side of said upper end of said base frame, two gears mounted on the upper end of said base frame, each said gears respectively rotates along with each said two link mechanisms, two said gears are engaged to synchronize two said link mechanisms, two handlebars downwardly are fixed to the upper synchronized mechanism respectively to each said link mechanisms, a lower synchronized mechanism mounted at the lower end of the base frame including two crank link mechanisms, each said crank link mechanisms symmetrically mounted at a left and a right side of the lower end of the base frame, two gears mounted on the lower end of said base frame, each said gears of the lower synchronized mechanism respectively rotates along with each said two crank link mechanisms, two said gears are engaged to synchronize two said crank link mechanisms, two foot pedals, each said foot pedals having a middle section connected to the lower synchronized mechanism respectively to each said crank link mechanisms and having front end mounted slidably on a connector shaft, a power transmission system mounted on a middle section of the base frame to make harmony between said upper and lower synchronized mechanisms and transferring power to a flywheel while increasing a speed ratio, a slide unit including two rails, each said rails fixed laterally at each side of the lower end of the base frame, two sliders, each said sliders having a bottom connected slidably to each said rail, the connector shaft having each end fixed at a top of each said slider, a controlling means including a control panel mounted on a console at a top of said base frame enabling the user to change resistance force during workout, and a magnetic brake installed on the middle section of said base frame.

BRIEF DESCRIPTION OF DRAWINGS

Other features and advantages of described invention will become apparent in the following detailed description of preferred embodiments with reference to the appended drawings, of which.

DETAILED DESCRIPTION OF EMBODIMENT

The description which follows and the embodiments described therein are provided by way of illustration of an example of particular embodiment of principles of present invention. This example is provided for the purposes of explanation and not limitation of those principles and of the invention.

Figure 1:
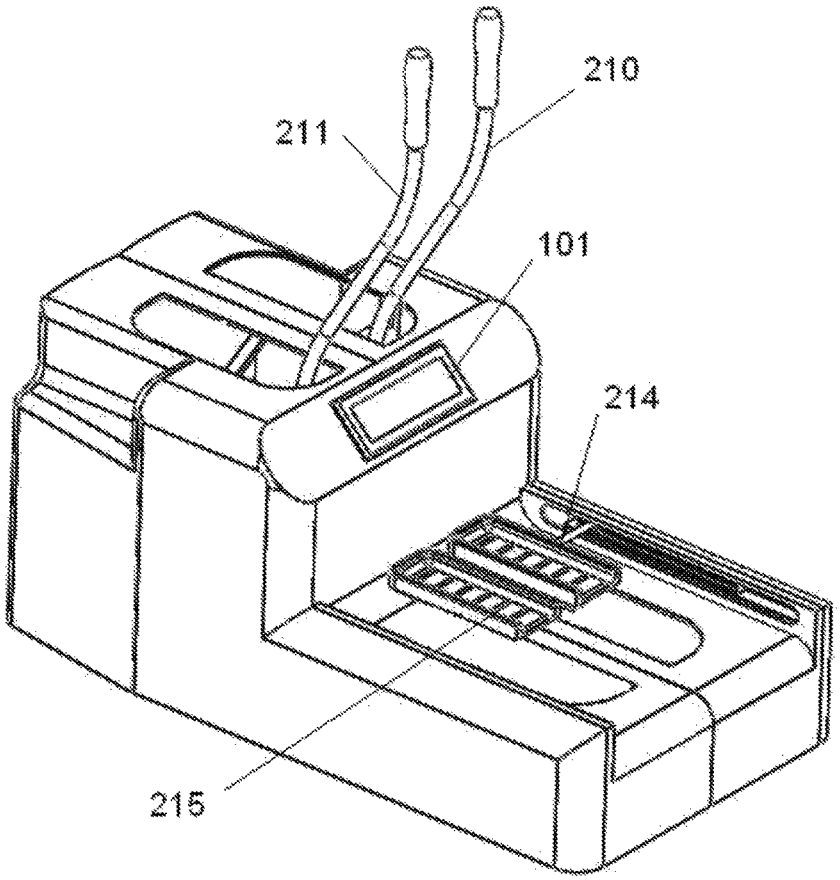
FIG. 1 is a perspective view of described exercise apparatus including all parts, cases and control panel.
Figure 2A:
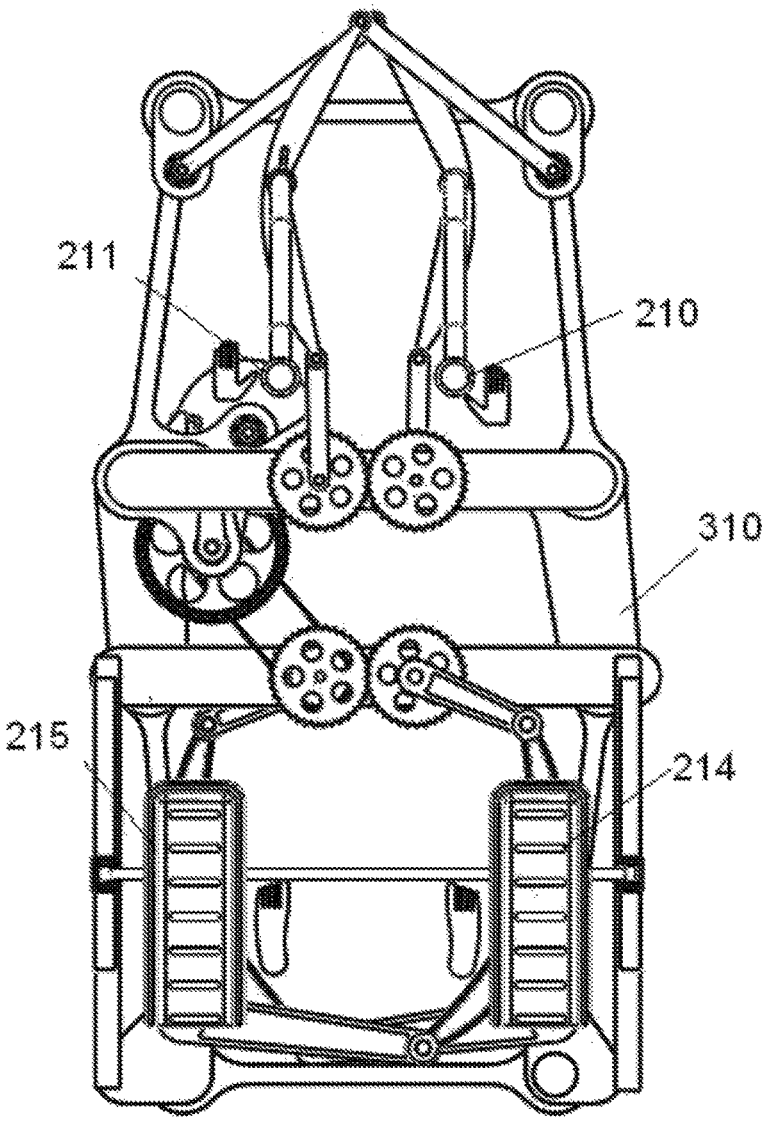
FIG. 2*a* is schematic top view of the described exercise apparatus shows mechanisms and position of the user's hands, handlebars, position of the user's feet, and foot pedals while user's hands are at a far point in relation to the user's feet.
Figure 2B:
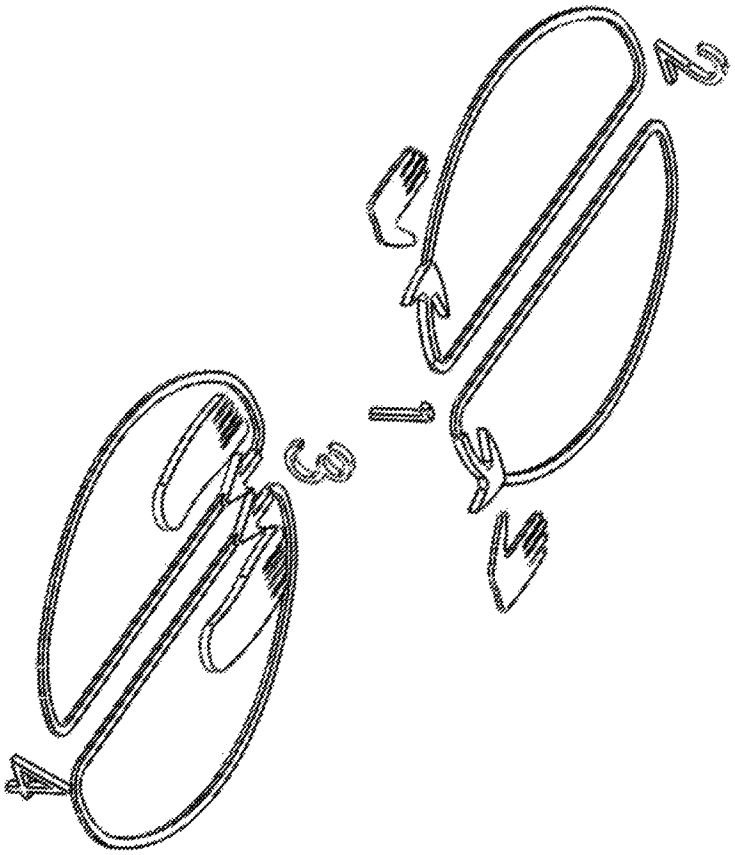
FIG. 2*b* is a perspective view of the symmetric semi elliptical routes and shows how the user's feet move longitudinally in opposite direction of the user's hands to reach to the farthest point in relation to each other so that the user's feet move from position 3 to position 4 while the user's hand move from position 1 to position 2.
Figure 3A:
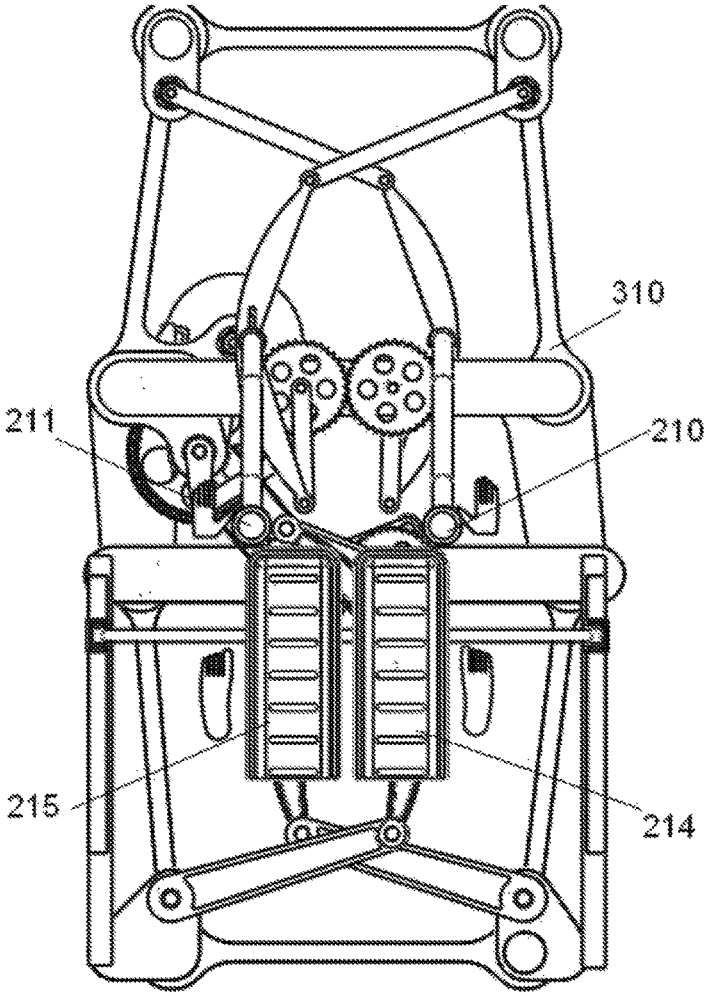
FIG. 3*a* is schematic top view of the described exercise apparatus shows the upper and lower synchronized mechanisms, position of the user's hands, handlebars, position of the user's feet, and foot pedals while the user's hands are at a nearest point in relation to the user's feet.
Figure 3B:
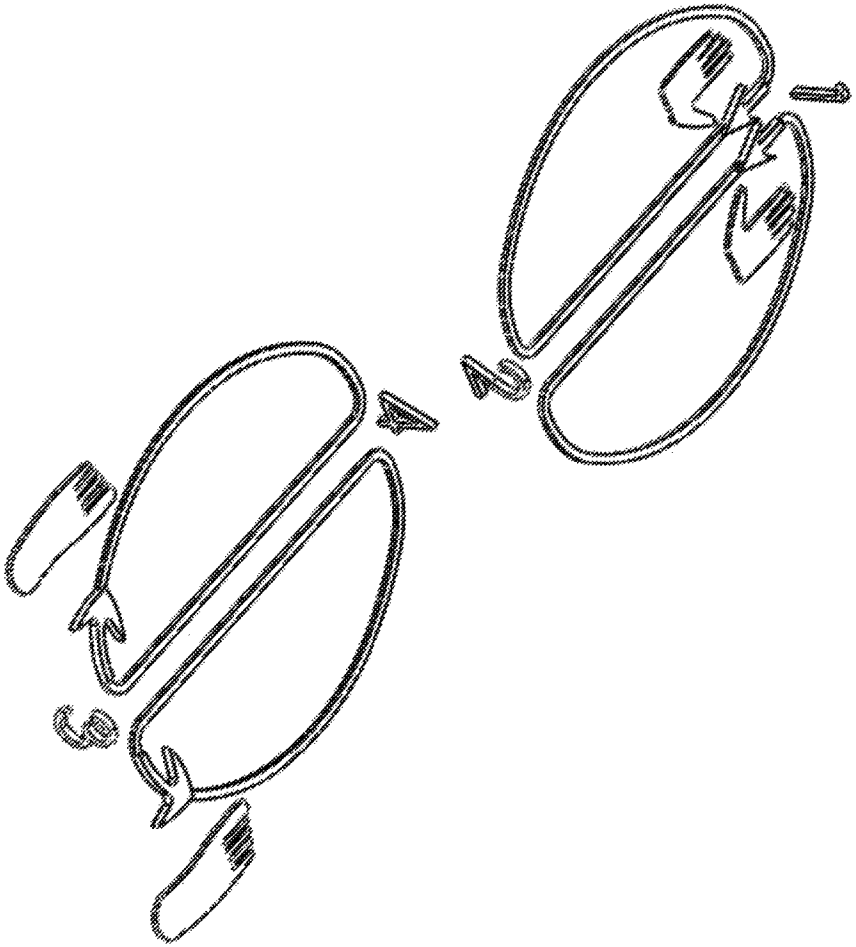
FIG. 3*b* is a perspective view of the symmetric semi elliptical routes and shows how the user's feet move longitudinally in opposite direction of the user's hands so that the user's feet move from position 3 to position 4 whiles the user's hand move from position 1 to position 2.
Figure 4:
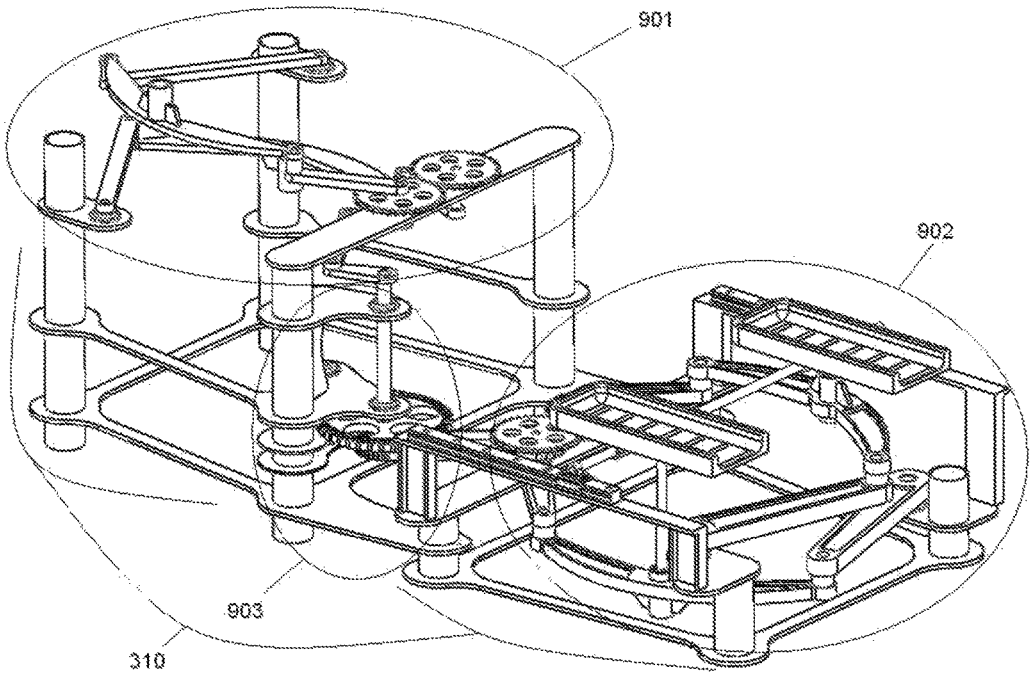
FIG. 4 is a perspective view of the described exercise apparatus shows main units of apparatus and where they are mounted on the base frame

Referring to FIGS. 1 to 12, the preferred embodiment of an exercise apparatus with divergent/convergent motion according to present invention is shown to comprise a base frame 310, upper synchronized mechanism 901, lower synchronized mechanism 902, power transmission system 903, slide unit 904 (see FIG. 4).

Figure 5:
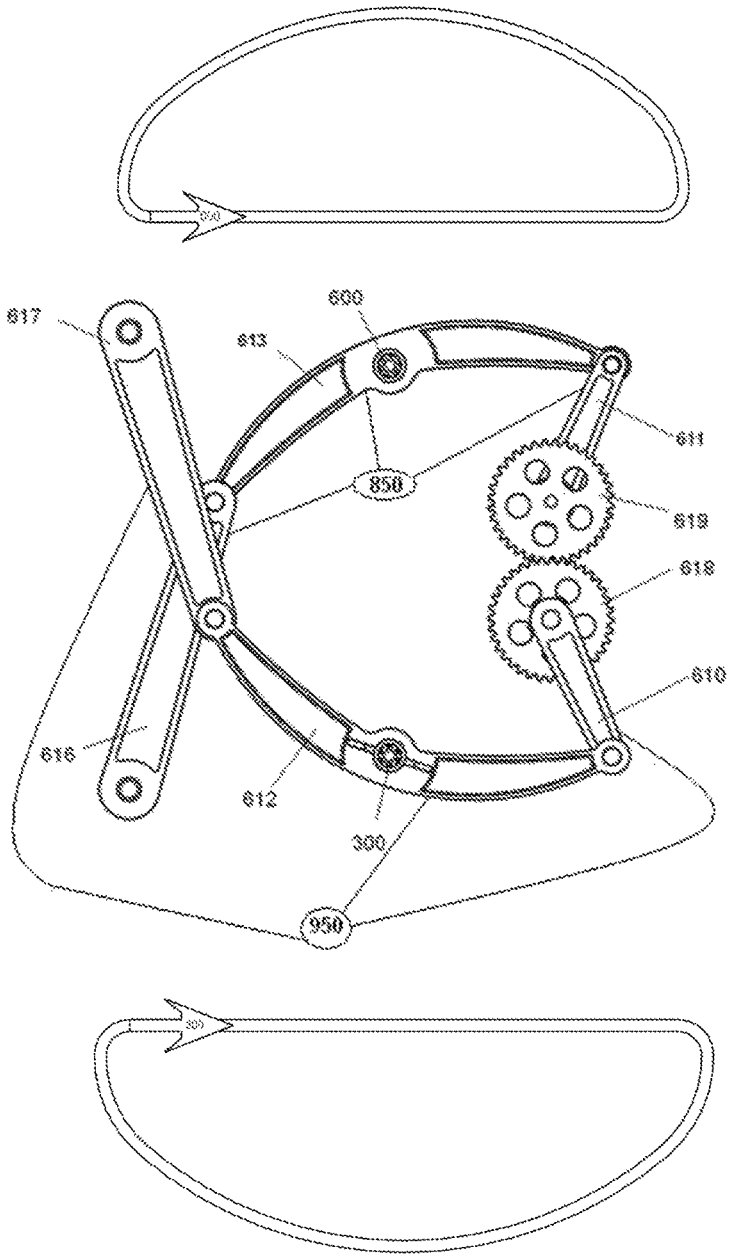
FIG. 5 is a schematic top view of the lower synchronized mechanism and the symmetric semi elliptical routes shows foot pedals connection points 300, 600 on the lower synchronized mechanism also how these points travel along the symmetric semi elliptical routes.
Figure 6:
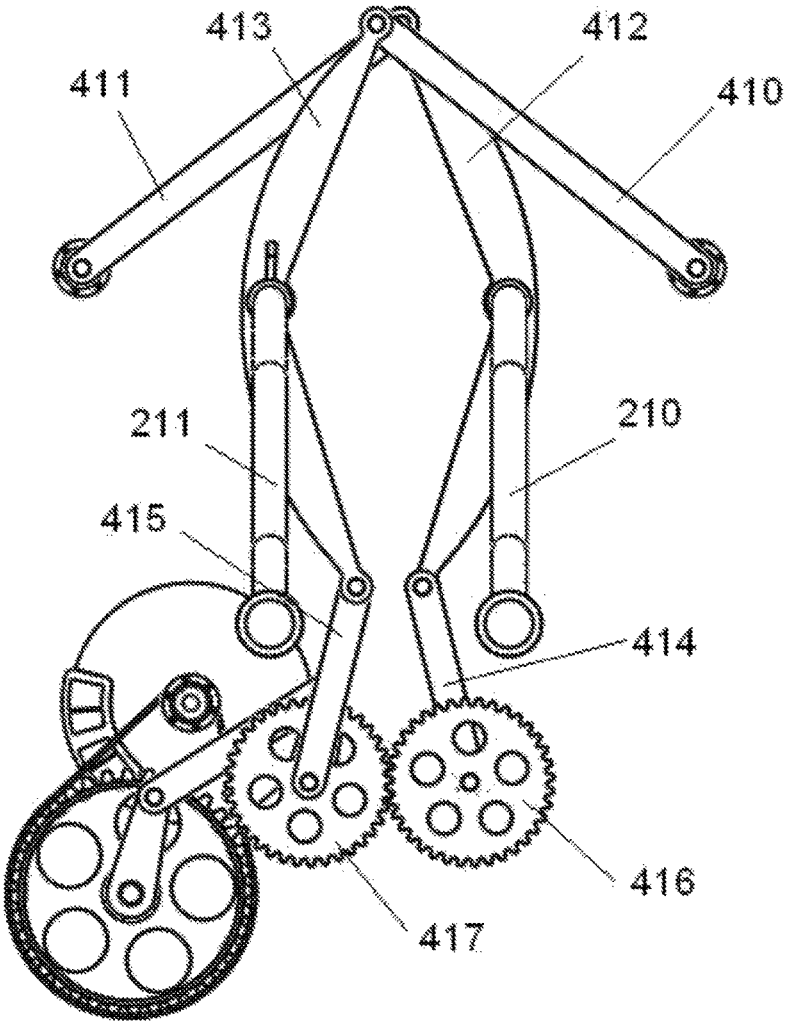
FIG. 6 is a schematic top view of the upper synchronized mechanism.
Figure 7:
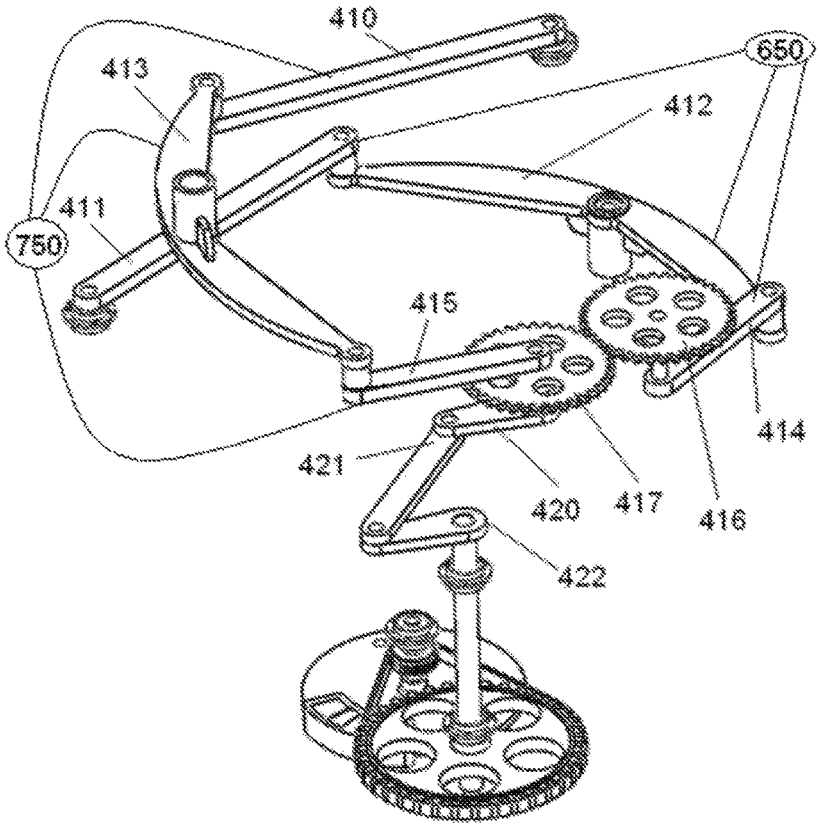
FIG. 7 is a perspective view of the upper synchronized mechanism.
Figure 8:
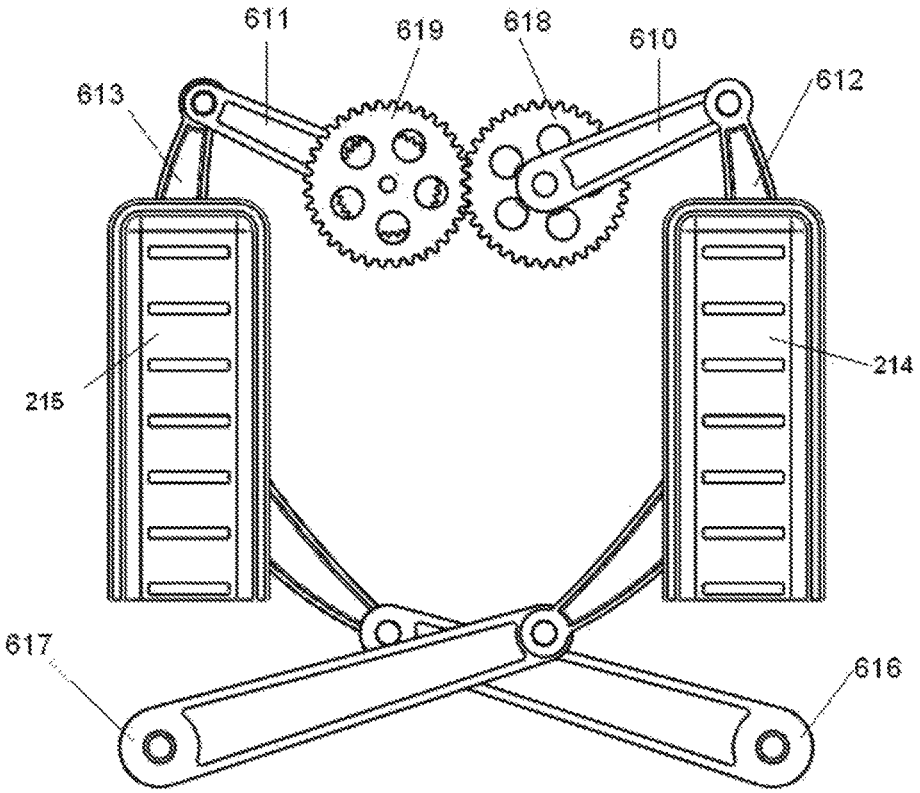
FIG. 8 is a top view of the lower synchronized mechanism.
Figure 9:
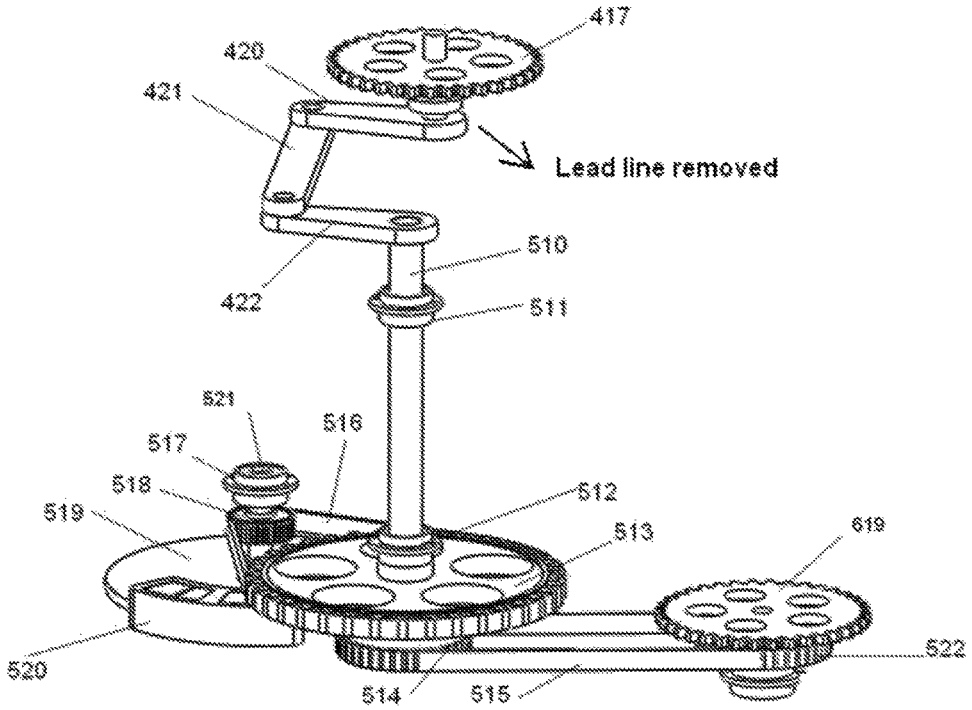
FIG. 9 is a perspective view of the power transmission system.

(New paragraph) The upper synchronized mechanism comprising two link mechanisms 650,750, and two gears 416,417 (FIG. 7), and the lower synchronized mechanism comprising two crank link mechanisms 850,950, and two gears 618,619 (FIG. 5).

Handlebars 210,211 are fixed downwardly to the upper synchronized mechanism respectively to a middle section of the middle links 412,413, oscillating links 410,411 having a front end connected pivotally to the upper end of said base frame and having a rear end respectively connected pivotally to a front end of the middle links 413,412, rotatable links 414,415 having a rear end connected pivotally to the upper end of said base frame and having a front end respectively connected pivotally to a rear end of the middle links 412, 413, Gears 416,417 connected pivotally to the upper end of said base frame and rotate respectively with rotatable links 414,415, two gears 416,417 are engaged to make harmony between two said link mechanisms. While the user starts to exercise, hands travel on the symmetric semi elliptical routes and links 414,415 rotate continuously with respective gears 416,417 CCW or CW depends on the user's hands travelling direction, meanwhile oscillating links 410,411 just have oscillating motion (see FIG. 6). rotatable bar link 420 having a front end connected pivotally to a front end of the middle bar link 421 and having a rear end connected pivotally to the upper end of said base frame and rotates along with rotatable link 415 and gear 417 to transfer upper synchronized mechanism revolution to the power transmission system rotatable bar link 422 having a front end connected pivotally to a rear end of the middle bar link 421 and having a rear end fixed to the main shaft 510 of the power transmission system (see FIGS. 7,9).

Figure 10:
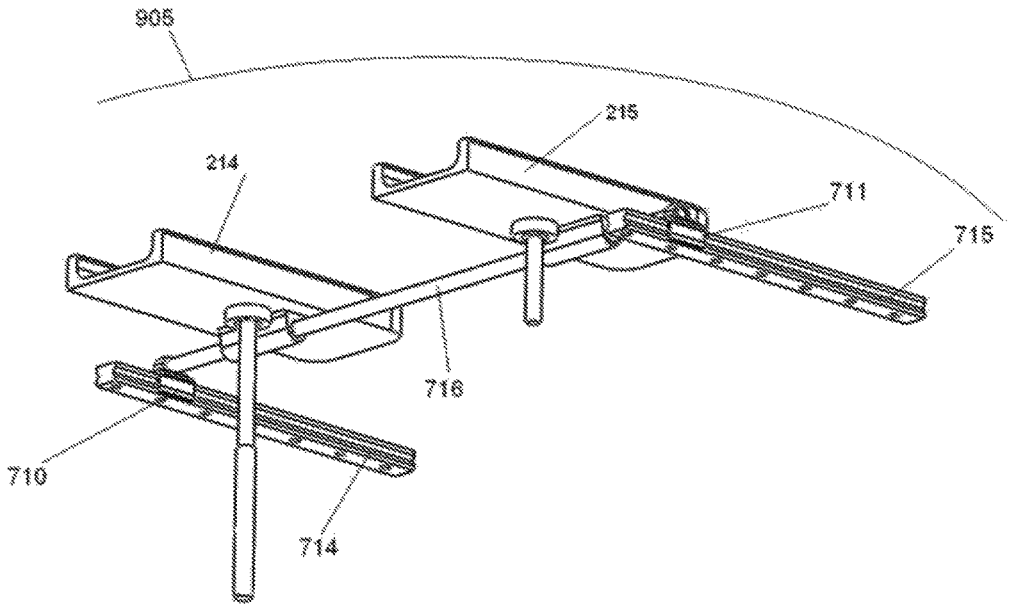
FIG. 10 is a perspective view of the slide unit.
Figure 11:
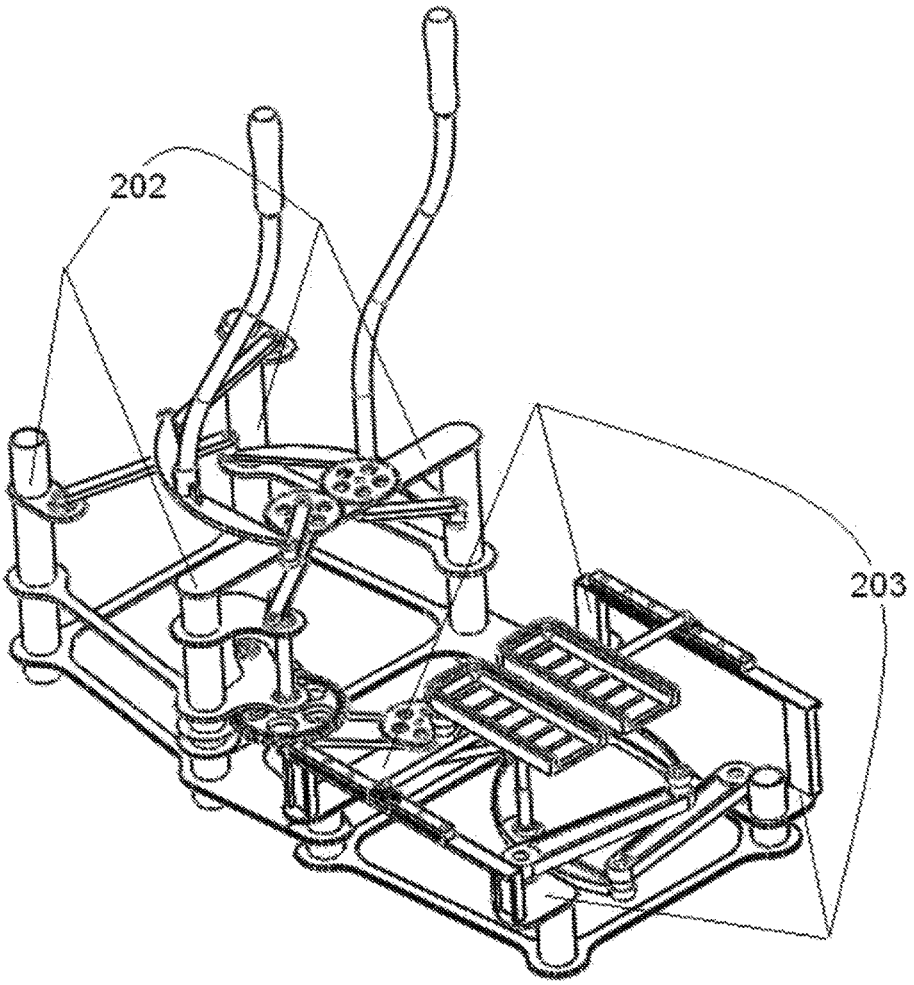
FIG. 11 is a perspective view of assembled described exercise apparatus.
Figure 12:
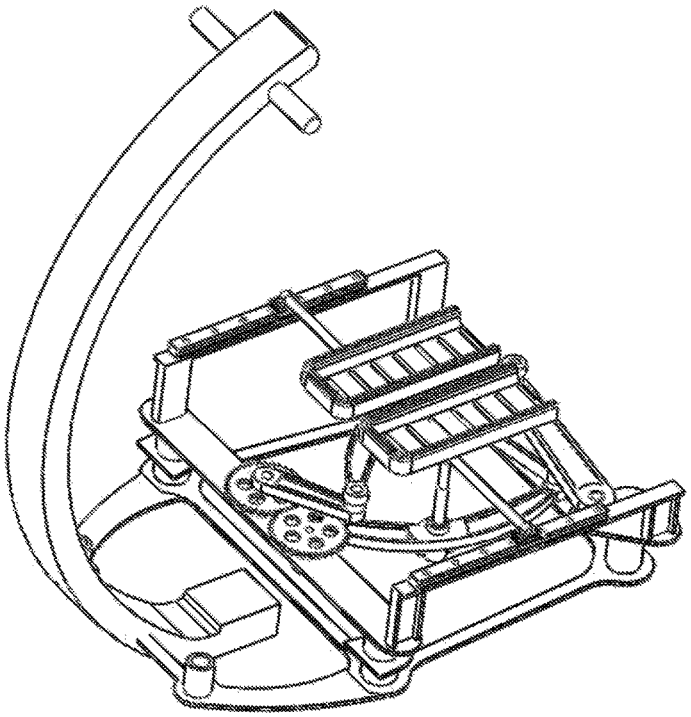
FIG. 12 is a perspective view of another aspect of described exercise apparatus. In this case user's upper body is fixed and user exercises just for lower body.

Foot pedals 214,215 having a middle section respectively connected pivotally to the shafts 712,713 and a front end connected slidably to the connector shaft 716 (see FIG. 10). Shafts 712, 713 are fixed downwardly to the lower synchronized mechanism respectively to a middle section of the middle crank links 612,613. oscillating crank links 616,617 having a rear end connected pivotally to the lower end of said base frame and having a front end respectively connected pivotally to a rear end of the middle crank links 613,612, rotatable crank links 610,611 having a front end respectively connected pivotally to a front end of the middle crank links 612,613 and having a rear end connected pivotally to the lower end of said base frame, Gears 618,619 connected pivotally to the lower end of said base frame and rotate respectively with rotatable crank links 610,611, gears 618,619 are engaged to make harmony between two said crank link mechanisms. While user starts to exercise, the user's feet travel along the symmetric semi elliptical routes and rotatable crank links 610,611 rotate continuously along with gears 618,619 CCW or CW depends on the feet travelling direction, oscillating crank links 616, 617 have oscillating motion(See FIGS. 8,10).

Timing pulley 522 connected rotatably on the lower end of said base frame and rotates along with gear 619. Timing pulleys 513,514 are fixed to the main shaft 510 and rotate along with the main shaft of the power transmission system. Timing belt 515 connects pulley 514 to pulley 522 and make harmony between upper and lower synchronized mechanisms. Main shaft 510 connected pivotally to the middle section of said base frame by two flanged roller bearing 511,512, Timing pulley 518 and flywheel 519 are fixed on the shaft 521, shaft 521 connected pivotally to the middle section of said base frame 310 by flanged roller bearing 517, magnetic brake 520 installed on the middle section of said base frame 310 for adjusting resistance force (see FIG. 9).

Rails 714,715 respectively are fixed to a left and a right, of the lower end of said base frame 310 and two sliders 710,711 respectively connected slidably to the rails 714,715, connector shaft 716 having each ends connected to atop of the two sliders 710,711, connector shaft 716 connected slidably to the front end of foot pedals 214,215 supporting foot pedals straightforward throughout the symmetric semi elliptical routes (see FIG. 10).

The described exercise apparatus further comprises a panel 10 mounted on the console at the top end of the said base frame 310. The panel 10 is a computerized device for showing the parameters such as heart rate of the user, calories burned or operating parameter such as apparatus velocity. Grip sections may include sensors (not shown) to detect the pulse rate of the user.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangement.

What is claimed is:

1. An exercise apparatus comprising:

a base frame;

an upper synchronized mechanism positioned at an upper end of the base frame and comprising two link mechanisms, each of the two link mechanisms positioned at a left and a right side of said upper end of the base frame symmetrically, each of said two link mechanisms comprising a rotatable link having a front end rotatably mounted to the base frame, a middle link having a front end pivotally connected to a rear end of the rotatable link such that motion of the middle link causes rotation of the rotatable link, said middle link having a rear end operatively associated with the base frame such that said rear end of the middle link having an oscillating motion, the middle link having a section distal from the rear end of the middle link, said section distal from the rear end of the middle link moves on a semi elliptical route, and two gears, said two gears are configured to synchronize said two link mechanisms, each of said two link mechanisms enabling a respective hand of a user's hands to move along a respective semi elliptical routes, the user's hands move forward/backward in a same direction longitudinally and have a laterally divergent/convergent motion while the user's hands are at a nearest point in relation to a middle section of the base frame and have a laterally convergent/divergent motion while the user's hands are at a farthest point in relation to said middle section of the base frame;

two handlebars, each of the two handlebars has a bottom end connected to said section distal from the rear end of said middle link of a respective one of the two link mechanisms and configured to be driven by a respective hand of the user's hands;

a lower synchronized mechanism positioned at said a lower end of the base frame and comprising two crank link mechanisms, each of the two crank link mechanisms positioned at, a left and a right side of the lower end of the base frame symmetrically, each of said two crank link mechanisms comprising a rotatable crank link having a front end rotatably mounted to the base frame, a middle crank link having a front end pivotally connected to a rear end of the rotatable crank link such that motion of the middle crank link causes rotation of the rotatable crank link, said middle crank link having a rear end operatively associated with the base frame such that said rear end of the middle crank link having the oscillating motion, the middle crank link having a section distal from the rear end of the middle crank link, said section distal from the rear end of the middle crank link moves along a semi elliptical route, and two gears, said two gears of the lower synchronized mechanism are configured to synchronize said two crank link mechanisms, each of said two crank link mechanisms enabling a respective foot of the user's feet to move along a respective semi elliptical route, the user's feet move forward/backward in the same direction longitudinally and have a laterally divergent/convergent motion while the user's feet are at a nearest point in relation to said middle section of the base frame and having laterally convergent/divergent motion while the user's feet are at a farthest point in relation to the middle section of the base frame;

two foot pedals, each of the two foot pedals has a middle section connected to said section distal from the rear end of said middle crank link of a respective one of the two crank link mechanisms and configured to be driven by a respective foot of the user's feet;

a power transmission system positioned at the middle section of the base frame transferring power between said upper and lower synchronized mechanisms, said power transmission system is configured to synchronized said upper and lower synchronized mechanisms so that the user's feet move in an opposite direction of the user's hands longitudinally, said power transmission system transferring power from said upper and lower synchronized mechanisms to a flywheel while increasing a speed ratio;

a slide unit positioned at said lower end of the base frame supporting said two foot pedals and maintaining a straight orientation of said two foot pedals longitudinally during an exercise; and a controlling means including a computerized device showing heart rate and burned calories of the user, the flywheel positioned at said middle section of the base frame, and a magnetic brake positioned at said middle section of the base frame adjusting resistance force on the flywheel, wherein adjusting said resisting force determines the effort required of the user.

2. The exercise apparatus of claim 1 wherein each of said two link mechanisms further comprises an oscillating link configured to connect the rear end of the middle link to the base frame so that said rear end of the middle link has the oscillating motion.

3. The exercise apparatus of claim 1 wherein each of said two gears of the upper synchronized mechanism rotates along with said rotatable link of a respective one of the two link mechanisms.

4. The exercise apparatus of claim 1, wherein each of said two handlebars transfers power produced by a respective hand of the user's hands to move a respective one of said two link mechanisms, and as a result said section distal from the rear end of said middle link of each of said two link mechanisms moves along with a respective one of the two handlebars along a respective semi elliptical route.

5. The exercise apparatus of claim 1 wherein each of said two crank link mechanisms further comprises an oscillating crank link configured to connect the rear end of the middle crank link to the base frame so that said rear end of the middle crank link has the oscillating motion.

6. The exercise apparatus of claim 1 wherein each of said two gears of the lower synchronized mechanism rotates along with said rotatable crank link of a respective one of the two crank link mechanisms.

7. The exercise apparatus of claim 1, wherein each of said two foot pedals transfers power produced by a respective foot of the user's feet to move a respective one of said two crank link mechanisms, and as a result said section distal from the rear end of said middle crank link of each of said two crank link mechanisms moves along with a respective one of the two foot pedals along a respective semi elliptical route.

8. The exercise apparatus of claim 1, wherein said slide unit further includes two rails, each of the two rails fixed laterally at each side of said lower end of the base frame, two sliders, each of the two sliders having a bottom and a top, said bottom of each of said two sliders slidably connected to a respective rail of said two rails of said slide unit, and a connector shaft having each end fixed at said top of each of said two sliders and having a middle section slidably connected to a bottom of each of said two foot pedals, said slide unit supporting said two foot pedals while each of said two foot pedals moves along a respective semi elliptical routes.

9. The exercise apparatus of claim 1 wherein said exercise apparatus is configured such that the user is able to move the user's hands in the same direction and in the opposite direction of the user's feet longitudinally while each of the user's hands and feet move in a divergent/convergent manner laterally.

* * * * *